US008622039B2

(12) United States Patent
Dougherty

(10) Patent No.: US 8,622,039 B2
(45) Date of Patent: Jan. 7, 2014

(54) ROCKERLESS DESMODROMIC VALVE SYSTEM

(76) Inventor: James T. Dougherty, Indianapolis, IN (US)

( * ) Notice: Subject to any disclaimer, the term of this patent is extended or adjusted under 35 U.S.C. 154(b) by 275 days.

(21) Appl. No.: 12/976,534

(22) Filed: Dec. 22, 2010

(65) Prior Publication Data

US 2012/0160199 A1 Jun. 28, 2012

(51) Int. Cl.
*F01L 1/30* (2006.01)

(52) U.S. Cl.
USPC ..... 123/90.24; 123/90.16; 123/90.26

(58) Field of Classification Search
USPC ..... 123/90.16, 90.24–90.26
See application file for complete search history.

(56) References Cited

U.S. PATENT DOCUMENTS

| | | | |
|---|---|---|---|
| 977,847 | A | 12/1910 | Wright |
| 1,185,925 | A | 6/1916 | Newcomb |
| 1,340,717 | A | 5/1920 | Holle |
| 1,644,059 | A | 10/1927 | Holle |
| 1,751,646 | A | 3/1930 | Nieman |
| 1,937,152 | A | 11/1933 | Jünk |
| 3,183,901 | A | 5/1965 | Thuesen |
| 3,430,614 | A | 3/1969 | Meacham |
| 4,327,677 | A | 5/1982 | Vander Bok |
| 4,711,202 | A | 12/1987 | Baker |

(Continued)

FOREIGN PATENT DOCUMENTS

| | | |
|---|---|---|
| EP | 1624161 A1 | 2/2006 |
| GB | 558779 | 1/1944 |
| GB | 2166799 A | 5/1986 |

OTHER PUBLICATIONS

"Classification," [online], undated, [retrieved Mar. 5, 2010]. Retrieved from the Internet: http://members.chello.nl/~wgj.jansen/text/classification.html (2 pages).

"One Hundred Years of Desmo-Patenting: A Factual Summary," [online], © 2001 [retrieved Dec. 22, 2010]. Retrieved from the Internet: http://members.chello.nl/~wgj.jansen/text/honderdjaar.html (8 pages).

(Continued)

*Primary Examiner* — Thomas Denion
*Assistant Examiner* — Daniel Bernstein
(74) *Attorney, Agent, or Firm* — William F. Bahret

(57) ABSTRACT

A desmodromic valve system which provides direct bidirectional displacement of a valve stem of an internal combustion engine without the aid of a rocker arm, utilizing a semirigid basket operating in conjunction with a plurality of cams for each valve. The basket is disposed about the camshaft of the engine and secured to the valve stem by an integral retainer on a bottom portion of the basket, and is constrained to motion along the valve stem axis. The basket has a pair of downwardly oriented cam followers in the upper portion thereof, spaced apart from the valve stem axis. A central cam and a parallel pair of side cams are fixedly mounted on the camshaft so as to rotate therewith, the cams substantially surrounded by the basket and cooperating therewith to provide reciprocating valve action with positive bidirectional drive. The central cam is aligned with the valve stem axis, and the side cams are spaced apart from the valve stem axis, parallel to the central cam and respectively aligned with the cam followers. During a first part of a valve cycle, the central cam pushes the valve stem down so as to positively open the associated valve, and the valve stem pulls said basket down with it via the retainer. During a second part of the valve cycle, the side cams push the basket up via their respective cam followers and thereby cause the basket to pull the valve stem so as to positively close the valve.

46 Claims, 3 Drawing Sheets

(56) References Cited

U.S. PATENT DOCUMENTS

| | | | | |
|---|---|---|---|---|
| 4,763,615 | A | 8/1988 | Frost | |
| 4,858,573 | A * | 8/1989 | Bothwell | 123/90.15 |
| 4,887,565 | A | 12/1989 | Bothwell | |
| 4,922,867 | A | 5/1990 | Mathews | |
| 5,048,474 | A | 9/1991 | Matayoshi et al. | |
| 5,058,540 | A | 10/1991 | Matsumoto | |
| 5,390,496 | A | 2/1995 | El Affaqui | |
| 6,276,324 | B1 | 8/2001 | Adams et al. | |
| 6,487,997 | B2 * | 12/2002 | Palumbo | 123/90.24 |
| 6,705,262 | B2 | 3/2004 | Battlogg | |
| 6,948,468 | B1 | 9/2005 | Decuir | |
| 6,951,148 | B2 | 10/2005 | Battlogg | |
| 7,051,691 | B2 | 5/2006 | Battlogg | |
| 7,421,988 | B2 | 9/2008 | Battlogg | |
| 2001/0032959 | A1 | 10/2001 | Parker et al. | |

OTHER PUBLICATIONS

"Produced Desmo-Systems," [online], undated, [retrieved Dec. 22, 2010]. Retrieved from the Internet: http://members.chello.nl/~wgj.jansen/desmosys.html#True%20desmodromic%20systems (3 pages).

"Desmodromic valve," [online], c.2010, [retrieved Dec. 22, 2010]. Retrieved from the Internet: http://en.wikipedia.org/wiki/Desmodromic_valve (5 pages).

International Search Report and Written Opinion dated May 1, 2012, Application No. PCT/US2011/066441, 11 pages.

(Sub)Classification of Desmodromic Valve Gear (IPC F01L1/30), [online], undated, [retrieved Jul. 19, 2012]. Retrieved from the Internet: http://members.chello.nl/~wgj.jansen/text/englishclass.html 7/, 5 pages.

* cited by examiner

ROCKERLESS DESMODROMIC VALVE SYSTEM

BACKGROUND OF THE INVENTION

This invention relates to desmodromic valve systems, and more particularly to desmodromic valve systems which provide direct bidirectional displacement of a valve stem without the aid of a rocker arm.

A desmodromic valve system positively opens and closes a valve in an internal combustion engine. This is in contrast to the conventional system in which the valve is positively opened with a cam but closed with a return spring.

The main benefit of a desmodromic system is the prevention of valve float. In traditional spring valve actuation, as engine speed increases, the inertia of the valve tends to overcome the spring's ability to close the valve completely before the piston reaches TDC (Top Dead Center). In severe cases, the piston contacts the open valve and causes damage to both engine parts. More generally, if a valve does not completely return to its seat before combustion begins, it can allow combustion gases to escape prematurely, leading to a reduction in cylinder pressure which causes a major decrease in engine performance. This can also overheat the valve, possibly warping it and leading to catastrophic failure. The traditional remedy for valve float is to use a stiffer return spring. This increases the seat pressure of the valve, i.e., the static pressure that holds the valve closed, and reduces valve float at higher engine speeds. However, the engine has to work harder to open the valve. The higher forces between spring and cam cause higher stress on the parts resulting in higher temperature and faster wear or failure in the valve drive system. A desmodromic system can avoid the problem to some extent because, although it has to work against the inertia of the valve opening and closing, it does not have to overcome the energy of the spring.

Despite their advantages, desmodromic valve drive systems have had limited success in commercial application for various reasons such as design complexity, poor reliability, and valve train binding. Numerous approaches to the various problems have been taken since the earliest days of engine development, more than a hundred years ago, as evidenced by the following patents:

| Pat. No. | Inventor(s) | Issue Date |
|---|---|---|
| 1,644,059 | Holle | Oct. 24, 1927 |
| 1,937,152 | Junk | Nov. 28, 1933 |
| 3,183,901 | Thuesen | May 18, 1965 |
| 3,430,614 | Meacham | Mar. 4, 1969 |
| 4,711,202 | Baker | Dec. 8, 1987 |
| 4,763,615 | Frost | Aug. 16, 1988 |
| 4,887,565 | Bothwell | Dec. 19, 1989 |
| 5,048,474 | Matayoshi et al. | Sep. 17, 1991 |
| 5,058,540 | Matsumoto | Oct. 22, 1991 |
| 6,276,324 | Adams et al. | Aug. 21, 2001 |
| 6,487,997 | Palumbo | Dec, 3, 2002 |
| 6,948,468 | Decuir | Sep. 27, 2005 |
| 6,951,148 | Battlogg | Oct. 4, 2005 |

However, presently, all known desmodromic valve designs have drawbacks which make them undesirable for use in several significant applications, such as production automobiles, and there is no obvious path to a better solution.

SUMMARY OF THE INVENTION

The present invention provides a rockerless desmodromic valve system comprising a first cam rotating on a camshaft and cyclically pushing a valve stem, a second cam on the camshaft, and a band extending circumferentially around the second cam and engaging the valve stem, the second cam rotating within the band and causing it to reciprocate so as to cyclically lift the valve stem. The system preferably but not necessarily has a wide band in the form of a basket large enough to encompass multiple cams and to extend completely around them circumferentially.

Another aspect of the invention is a desmodromic valve system comprising a semirigid band, which may be in basket form, disposed about a camshaft of an internal combustion engine, the semirigid band attached to a valve stem and constrained to motion along the valve stem axis. The system includes rotatable cam means mounted on the camshaft and disposed within the band for coacting with it without substantially changing its shape to positively drive the valve stem in both directions along its axis and thereby provide reciprocating valve action with positive bidirectional drive.

The objects and advantages of the present invention will be more apparent upon reading the following detailed description in conjunction with the accompanying drawings.

BRIEF DESCRIPTION OF THE DRAWINGS

FIG. 1 is a side view of the assembly with the valve closed, and with the basket and two side cam followers shown in longitudinal cross-section.

FIG. 2 is a transverse cross-section along line 2-2 of FIG. 1.

FIG. 3 is a transverse cross-section along line 3-3 of FIG. 4.

FIG. 4 is a longitudinal cross-section of the assembly with the valve open.

FIG. 5 is a bottom view of the basket alone, taken along line 5-5 of FIG. 1.

FIG. 7 is a side view of the assembly with the valve closed, and with the basket and two side cam followers shown in longitudinal cross-section.

FIG. 8 is a transverse cross-section along line 8-8 of FIG. 7.

FIG. 9 is a transverse cross-section along line 9-9 of FIG. 10.

FIG. 10 is a longitudinal cross-section of the assembly with the valve open.

DESCRIPTION OF PREFERRED EMBODIMENTS

Figure 1:
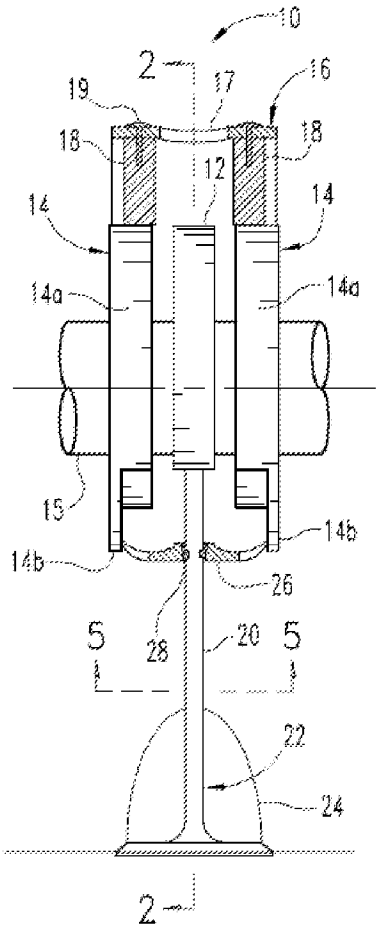
FIGS. 1-5 depict a first embodiment of a rockerless desmodromic valve system according to the present invention. This embodiment includes a semirigid band or "basket" that substantially surrounds a set of cams on a camshaft and engages paired side cams and an associated valve stem so as to pull the valve stem after it is pushed by a central cam. The basket and cams, which are drawn to scale for a nominal ½ inch valve lift, cooperate to provide reciprocating valve action with positive bidirectional drive.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIGS. 1-5, wherein like numerals represent like parts throughout the several views, depict a first embodiment 10 of a rockerless desmodromic valve system according to the present invention. In this embodiment, which is to be understood as one example of a desmodromic valve system according to the present invention, a central cam 12 and a parallel pair of side cams 14 are fixedly mounted on a camshaft 15 so as to rotate therewith, and are substantially surrounded by a semirigid band or "basket" 16 which does not rotate with the camshaft and is constrained by the cams and by its attachment to the stem 20 of a valve 22. Except as described herein, the camshaft and valve may be conventional parts mounted in a conventional manner in the cylinder head of an internal combustion engine in which each valve has an associated port 24 and has a valve guide (not shown) which closely surrounds the valve stem.

Basket 16 engages paired side cams 14 and the associated valve stem 20 so as to pull the valve stem after it is pushed by central cam 12. The basket and cams cooperate to provide reciprocating valve action with positive bidirectional drive. That is, the system positively drives the valve from its closed position, illustrated in FIGS. 1 and 2, to its open position, illustrated in FIGS. 3 and 4, by conventional cam action by means of cam 12 in contact with the valve stem, and positively drives the valve back to its closed position using the basket, which is secured to the valve stem and raised by paired cams 14 acting through associated cam followers 18.

Figure 2:
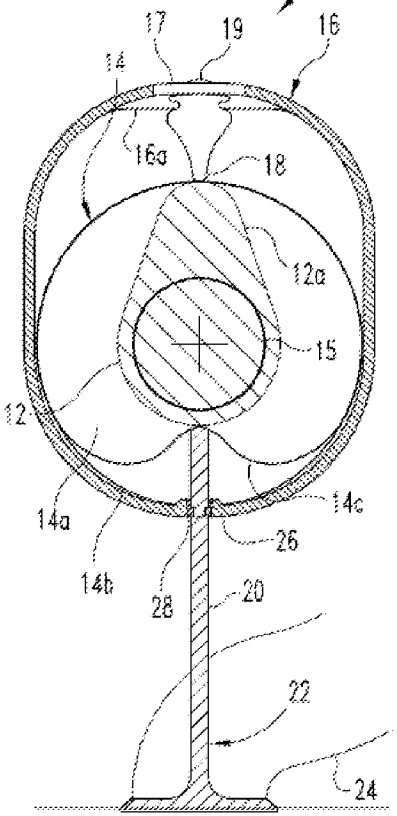

Each cam 14 has a main portion 14*a* with a concavo-convex cross-section, and a peripheral portion or shoulder 14*b* with a circular cross-section. The concavo-convex cross-section of the main portion of cam 14 is readily apparent in FIGS. 2 and 3. In FIGS. 1 and 2, the concave part 14*c* of main portion 14*a* of cam 14 is below the camshaft axis (and axially separated from the valve stem), and the convex portion engages the associated cam follower 18 and thereby holds the basket in its raised position. Cams 12 and 14 operate in coordinated fashion such that, at this point in the cycle, lobe 12*a* of cam 12 is oriented away from the valve stem and thereby allows the valve to be lifted and thus closed by the basket. Conversely, in FIGS. 3 and 4, part 14*c* of cam 14 is above the camshaft axis and lobe 12*a* of cam 12 is oriented toward the valve stem, whereby cam follower 18—and thus basket 16—is in its lowest position and the valve is open. A cam follower, such as a snug-fitting cup (not shown), is preferably also provided on the upper end of the valve stem for contact with cam 12.

Figure 6:
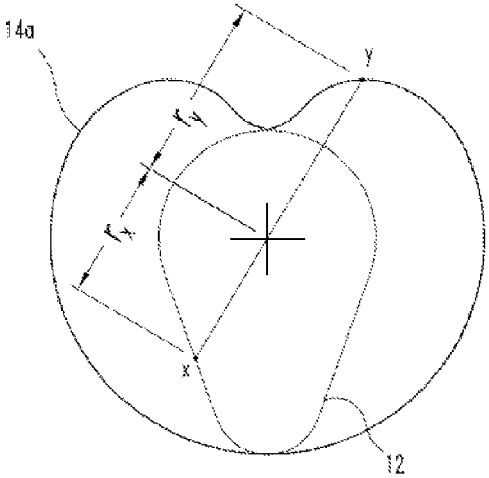
FIG. 6 shows reference points on the central cam and one side cam pertaining to the relationship between the cam radii in a preferred embodiment of the present invention.

As one example of a set of suitable dimensions for valve system 10, cam 12 may have a maximum radius of 1 inch (at the outermost point on lobe 12*a*) and a minimum radius of ½ inch, thereby producing a valve lift—the valve displacement between open and closed positions—of ½ inch. Cam portion 14*a* has the same maximum and minimum radii as cam 12, and its radius at any given point is a function of the radius of cam 12 at a diametrically opposed point. Specifically, cam 12 and cam portion 14*a* are designed such that, at any two diametrically opposed points X and Y on their respective surfaces (see FIG. 6), $$r_x+r_y=c$$

The cams are thus complementary. With the above example dimensions, the sum of the radius of cam 12 and the radius of cam portion 14*a* at such points X and Y is 1.5". For example, the outermost point on lobe 12*a* is diametrically opposed to the center of concave part 14*c* of cam 14, and the respective radii at those points are 1.0" and 0.5", the sum of which is 1.5".

Basket 16 has a retainer 26 integrally formed in a reinforced bottom portion thereof. The retainer cooperates with a plurality of keys or keepers 28 to secure the basket to the valve stem. The retainer has a downwardly tapered hole and the keepers are likewise downwardly tapered such that the retainer and associated keepers together form a valve stem lock. The keepers are shaped so as to extend into the groove of the valve stem and are held therein by wedging action of the cooperatively tapered portion of the retainer. The retainer may alternatively be formed as a separate part fitted into a hole in the basket. Examples of retainer/keeper sets are disclosed in U.S. Pat. Nos. 4,327,677 and 4,922,867, which are incorporated herein by reference.

In an alternative embodiment suited for valves in which the groove is closer to the tip of the stem than in the first embodiment, the retainer is formed in the top of a hollow conical member extending up from the bottom of the basket enough to enclose the groove. The system may also provide an extension of the valve guide as additional lateral support for the stem in retrofit applications involving removal of a return spring. In cases with replaceable valve guides, a longer valve guide may be installed which extends into the space formerly occupied by the return spring. In other cases, e.g., heads with cast guides, the guide may be drilled and tapped to receive a threaded cylindrical extension, preferably with an oil seal and/or a roller guide on top.

Figure 3:
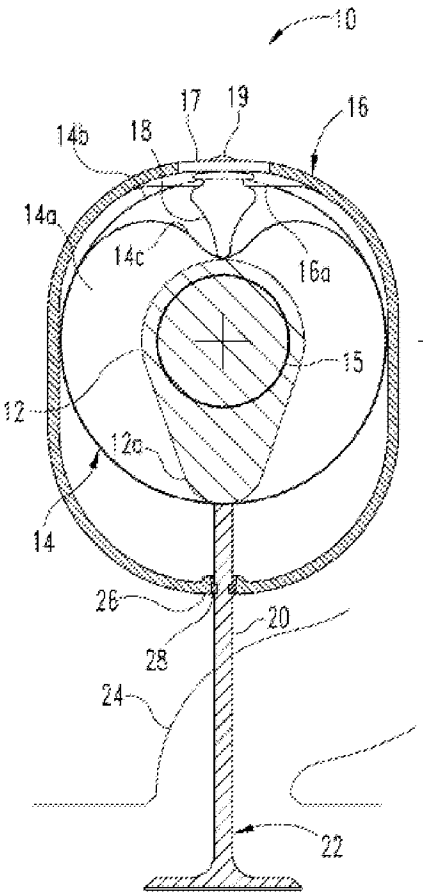

The basket also includes a reinforced upper portion or flange 16*a* adjacent each axial end for a cam follower 18, the flange and cam follower having complementary shapes for retaining the cam follower as shown in FIGS. 2 and 3. A hole 17 is provided in the top of the basket for insertion of the cam followers. The cam follower may comprise a roller.

Figure 4:
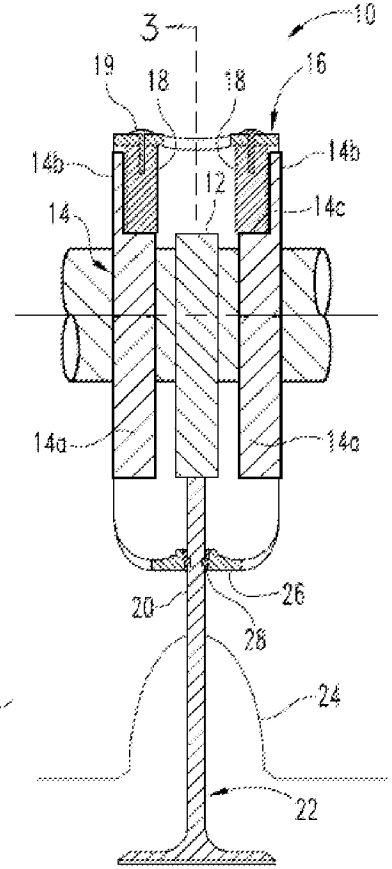

The basket preferably has a unitary, or monocoque, construction, with solid side walls and open ends, and is semirigid, i.e., slightly flexible but sufficiently rigid that it experiences less than 1% elongation in response to forces applied to it during a cycle of operation of the valve to which it is connected—including in particular the forces applied in the process of returning the valve to its closed position—at camshaft speeds from zero to 5,000 RPM. For example, a basket with a nominal height of 2.5" experiences elongation of less than 0.025" as it pulls the valve stem to close the valve at camshaft speeds up to 5,000 RPM. Basket elongation is the primary contributor to the dynamic lash of the valve, which is understood to be the variable lash occurring in operation, i.e., the clearance between the valve stem and cam 12 during operation. Basket elongation of up to 0.100" may be suitable with certain engine designs, but the basket is preferably sufficiently rigid that it limits the dynamic lash to 0.020-0.030", more preferably less than 0.010" and, most preferably, 0.005" or less. One suitable material is thin-wall cast titanium. There is preferably a gap between the bottom portion of the basket and shoulder 14*b* when the valve is closed (FIG. 2) and, likewise, a gap between the top portion of the basket and shoulder 14*b* when the valve is open (FIGS. 3 and 4). The basket is preferably dimensioned to provide a gap of at least 0.001" at substantially all points between it and cam 14 at rest.

The assembly process begins by mounting the baskets on the camshaft before the camshaft is installed in the head. The baskets are moved axially over the cams on the camshaft to their respective cams 12 and 14. When all the baskets are so mounted, the camshaft is placed in the bearing blocks in the head and secured. Each valve is then installed by sliding its stem through a valve guide and through the hole in the bottom of an associated basket. With the cams oriented as shown in FIG. 2, the stem is advanced and the basket is lowered as necessary for the groove in the stem to pass beyond the retainer in the basket, and the keepers are then inserted through one or both open ends of the basket and placed in the groove, after which the retainer is moved into place surrounding the keepers, thereby holding them in the groove. Each cam follower 18 is then inserted through the hole 17 in the top of the basket and slid into a flange 16*a*, where it is preferably secured in place with a fastener, e.g., screw 19, extending into the flange through the top of the basket. Screws 19 are preferably aircraft bolts with anti-rotation features, e.g., drilled heads having a common safety wire through them. The top of the cam follower may be tapered in the direction away from hole 17 to provide a wedge shape to facilitate insertion into the flange. Insertion of cam follower 18 pre-loads the valve stem and tensions, i.e., slightly stretches or elongates, the basket. Cam follower 18 is suitably dimensioned to perform this function.

In operation, starting from the valve-closed position shown in FIGS. 1 and 2, the camshaft rotates nearly 135° to a point at which cam lobe 12*a* begins to engage the valve stem and cam follower 18 simultaneously begins to engage a smaller-radius portion of cam portion 14*a*. Cam lobe 12*a* then exerts a downward force on the valve stem until the camshaft has rotated 180°, to the valve-open position shown in FIG. 3. The valve stem is free to move down because cam follower 18 engages the smaller-radius portion of cam portion 14*a*, including concave part 14*c*, during this part of the cycle, and the valve stem pulls the basket down with it as shown in FIG. 3. Further camshaft rotation causes cam lobe 12*a* to rotate away from the valve stem and correspondingly brings cam follower 18 into contact with points of progressively larger radius on cam portion 14*a*. Cam portion 14*a* thereupon exerts an upward force on cam follower 18 which lifts the basket, which in turn pulls the valve stem up. When the camshaft has rotated a little more than 45° from the position shown in FIG. 3, cam follower 18 again bears against the maximum-radius portion of cam portion 14*a* and the valve is closed. The valve and basket positions at this point are as shown in FIGS. 1 and 2 and remain so for the remainder of the cycle. It will be understood that the above-mentioned angles of 135° and 45° are mere examples and that the angles at which cam lobe 12*a* engages and disengages from the valve stem are functions of desired cam action for a desired valve application.

The circular peripheral portions 14*b* of cam 14 are provided to resist flexing of the basket and thereby limit its maximum elongation as the valve closes, at which time the concave part 14*c* of cam 14 moves toward one side of the basket and opens up a significant gap. By virtue of their fixed 1" radius, portions 14*b* maintain a minimum of 2" spacing between the opposed sides of the basket at least where they make contact with it. Portions 14*b* (shoulders) may be on either or both sides of each side cam 14 on the camshaft axis, i.e., the side closer to the central cam, the opposite side, or both. The side closer to the central cam is closer to the line of force (tension) between stem 22 and cam follower 18 during valve closure. Alternatively, a constant-radius disc such as portion 14*b* may be provided on either or both sides of central cam 12, and such a disc may help with camshaft balancing.

In an alternative embodiment, the desmodromic valve system has a parallel pair of rings or bands instead of the basket described above. The bands are preferably joined at the bottom by a bridge which includes a retainer such as described above, in a unitary construction or as separate parts. A single band with a single cam 14 is also contemplated.

The basket with cam follower(s) 18 is effectively a clamp. In cooperation with cam(s) 14, it clamps the central cam (cam 12) to the valve stem, whereby the valve stem is virtually an ideal cam follower throughout the valve cycle. It is strongly preferred to have the clamp extend completely around the central cam circumferentially as shown in the drawings and described above. However, in some applications, it may be adequate for the clamp to extend around the cam on only one side of the camshaft, i.e., the left or right side as viewed in FIG. 2, akin to a C-clamp, with curved or straight vertical and horizontal segments. The clamp may comprise one half of the basket described above, i.e., the left or right half as viewed in FIG. 2, but including the full retainer and keys and the cam followers as described above. The cam followers may be fixed in position in supporting flanges as described above, or may be vertically adjustable by means of a threaded connection to the top of the clamp or otherwise. Alternatively, the cam followers may be integral parts of the clamp. Such a clamp is provided, if necessary, with suitable means to keep it aligned with the valve stem. For example, a horizontal support bar or guard rail may be provided on the head so as to abut the back side of the half basket (the side opposite the cam) at the level of the camshaft axis. The support bar may, for example, be bolted or otherwise secured to adjacent bearing blocks.

As an alternative to the half basket just described, a clamp in the form of a half ring akin to a C-clamp may be adequate in some applications. This clamp may have approximately the same width along the camshaft axis as cam 14, and be aligned with that cam, but have an axial projection rigidly connecting it to the valve stem. It may have the same general cross-sectional shape as the left or right half of the basket as viewed in FIG. 2. If necessary, a horizontal support bar or guard rail, as described above, is provided which includes a vertical guide, such as a slot to receive the back of the clamp, to keep the clamp vertically aligned.

Cams 12 and 14 have complementary shapes as described above, and they are preferably complementary around their entire circumferences, but may be partially complementary in certain applications. It is particularly advantageous for cam 14 to complement cam 12 for the valve-closing portion of the valve cycle, so as to generate a lifting force via the basket or other clamp as soon as the maximum-radius portion of cam lobe 12*a* is past the valve stem. However, an upward force is not necessarily required from the basket during every part of the valve cycle, e.g., during the compression stroke and power stroke of a four-stroke engine, and so, in some applications, the side cam may have a relatively small radius for a significant part of its circumference corresponding to such parts of the cycle (and thus have less rotating mass), provided that the basket is suitably secured to the valve stem and kept aligned with it. The basket may be secured by means of a cap screwed over the keys to keep them in place, or, for some applications, a threaded connection without keys may be adequate. A horizontal support bar or guard rail as described above may be provided on each side of the basket for alignment purposes if necessary.

Figure 3A:
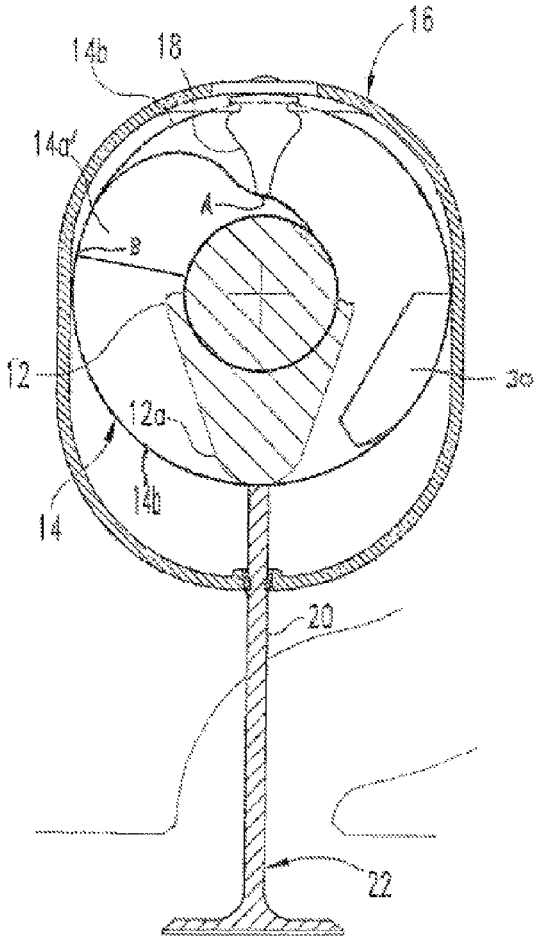
FIG. 3A is a transverse cross-section like that of FIG. 3 but with the central cam partially cut away to show the shape of an alternative side cam.
Figure 5:
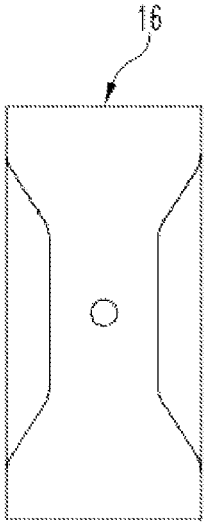

One example of such a side cam is cam 14*a*' in FIG. 3A. Cam 14*a*' is designed for clockwise rotation. It extends approximately 120° around the camshaft as illustrated, and it has the same radius as cam 14*a* of the first embodiment for approximately 90°, in the circumferential range from point A to point B, which includes the valve-closing portion of the valve cycle. Those skilled in the art will appreciate that cam 14*a*' and cam 12 are complementary for that part of the valve cycle. This embodiment preferably includes a circular portion 14*b* joined to cam 14*a*' and having a constant 1" radius as in the first embodiment. A counterweight 30 is optionally provided on the opposite side of the camshaft from cam 14*a*' for balancing purposes, and may be mounted on portion 14*b* as shown. Camshaft balance can also be achieved by removing weight, e.g., by machining away areas of portion 14*b* adjacent to cam 14*a*', and/or by initially forming such adjacent areas and cam 14*a*' itself with apertures therein, such as in a spoked wheel. Camshaft balance can be achieved by adding or deleting material or a combination of the two.

Depending on the rigidity of the basket, portion 14*b* may be made with a greater axial width (along the camshaft axis) than portion 14*b* in the first embodiment, for purposes of structural integrity. Alternatively, a cam 14 may have a part 14*a*' (as in FIG. 3A) with the axial width of original part 14*a* (see FIG. 1), and also include the remainder of original part 14*a* but with half its width, whereby some part of cam 14 engages cam follower 18 throughout the cycle, thus maintaining the preload on the valve stem and reinforcing portion 14*b*.

Another embodiment 110 of the invention is depicted in FIGS. 7-10, wherein like numerals represent like parts throughout the several views. This embodiment and variations thereof may be the same as the embodiment of FIGS. 1-5 and its variations as discussed above, with exceptions as discussed below. A central cam 112 and a parallel pair of side cams 114 are fixedly mounted on a camshaft 115 so as to rotate therewith, and are substantially surrounded by a semirigid band or "basket" 116 which does not rotate with the camshaft and is constrained by the cams and by its attachment to the stem of a valve 122.

The primary difference with this embodiment is that the basket and cams are designed for a ¼ inch valve lift. Basket 116 engages paired side cams 114 and the associated valve stem so as to pull the valve stem after it is pushed by central cam 112. The basket and cams cooperate to provide reciprocating valve action with positive bidirectional drive. That is, the system positively drives the valve from its closed position, illustrated in FIGS. 7 and 8, to its open position, illustrated in FIGS. 9 and 10, by conventional cam action by means of cam 112 in contact with the valve stem, and positively drives the valve back to its closed position using the basket, which is secured to the valve stem and raised by paired cams 114 acting through associated cam followers 118.

Figures 7, 8, 9, 10:
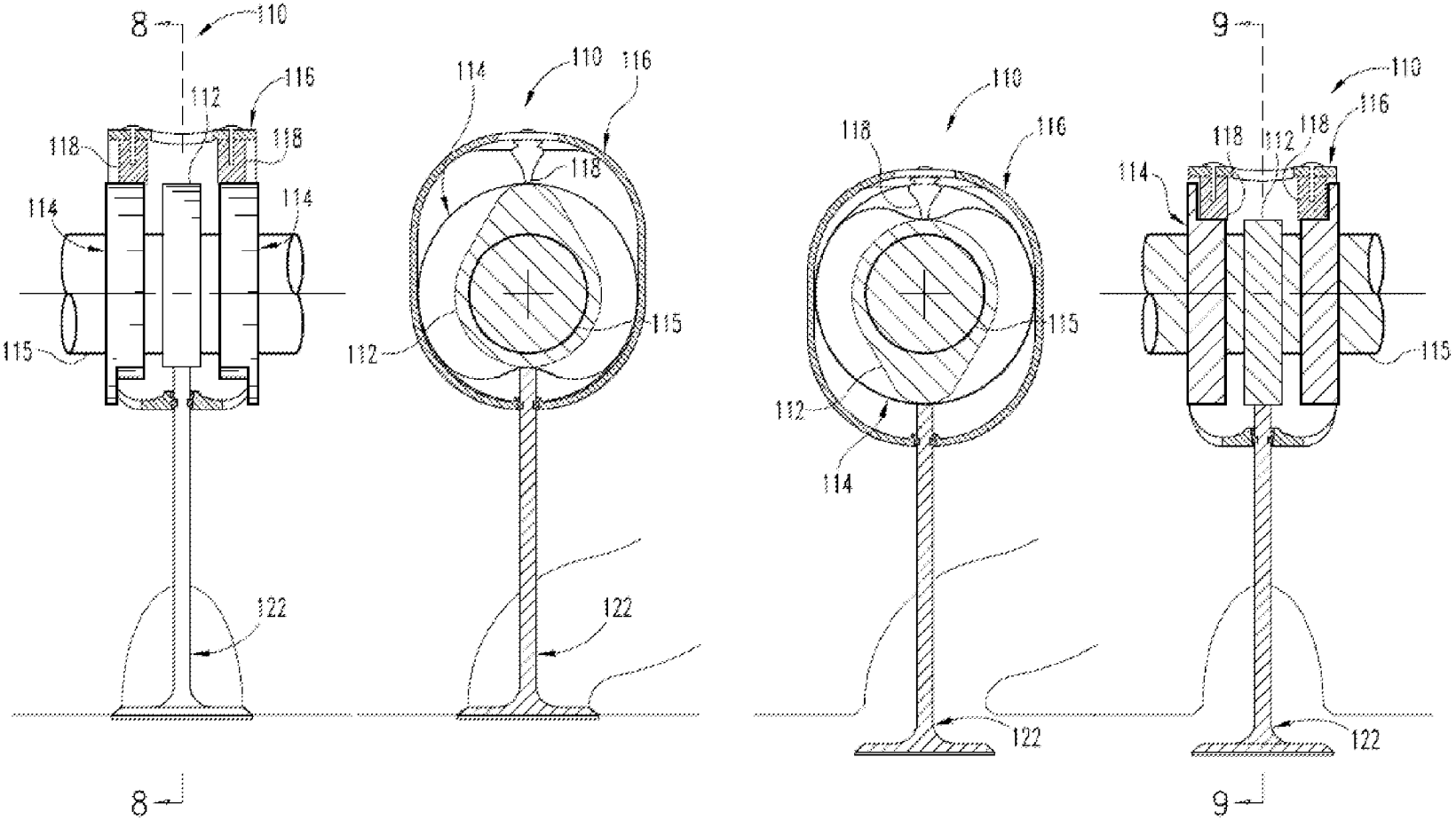
FIGS. 7-10 depict a second embodiment of a rockerless desmodromic valve system according to the present invention. Like the first embodiment, this embodiment includes a semirigid band or "basket" and a set of cams including a central cam and a pair of side cams. The basket and cams in this case are drawn to scale for a nominal ¼ inch valve lift.

Each cam 114 has a main portion with a concavo-convex cross-section, and a peripheral portion or shoulder with a circular cross-section. In FIGS. 7 and 8, the concave part of cam 114 is below the camshaft axis (and axially separated from the valve stem), and the convex portion engages the associated cam follower 118 and thereby holds the basket in its raised position. Cams 112 and 114 operate in coordinated fashion such that, at this point in the cycle, the lobe of cam 112 is oriented away from the valve stem and thereby allows the valve to be lifted and thus closed by the basket. Conversely, in FIGS. 9 and 10, the concave part of cam 114 is above the camshaft axis and the lobe of cam 112 is oriented toward the valve stem, whereby cam follower 118—and thus basket 116—is in its lowest position and the valve is open.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

I claim:

1. A desmodromic valve system for an internal combustion engine having a plurality of valves with valve stems operatively connected to a camshaft, said system comprising:

a semirigid basket disposed about said camshaft, said semirigid basket secured to a first valve stem by an integral retainer on a bottom portion thereof and constrained to motion along the valve stem axis, said basket having a pair of downwardly oriented cam followers in the upper portion thereof, spaced apart from the valve stem axis, said basket being flexible enough to elongate to contribute to the dynamic lash of the valve; and a central cam and a parallel pair of side cams fixedly mounted on said camshaft so as to rotate therewith, said cams substantially surrounded circumferentially by said basket and cooperating therewith to provide reciprocating valve action with positive bidirectional drive, said central cam aligned with the valve stem axis, said side cams spaced apart from the valve stem axis, parallel to said central cam and respectively aligned with said cam followers, said central cam pushing said valve stem down so as to positively open the associated valve during a first part of a valve cycle, said valve stem pulling said basket down with it via said retainer, said side cams pushing said basket up via their respective cam followers and thereby causing said basket to pull said valve stem so as to positively close the valve during a second part of the valve cycle.

2. The desmodromic valve system of claim 1, wherein the sum of the radii of said central cam and either of said side cams at any two diametrically opposed points on their respective cam surfaces is constant.

3. The desmodromic valve system of claim 1, wherein said basket is flexible enough to contribute materially to dynamic lash but sufficiently rigid that it experiences less than approximately 1% elongation in response to forces applied to it during a full valve cycle at camshaft speeds up to 5,000 RPM.

4. The desmodromic valve system of claim 3, wherein said basket is made of titanium and is sufficiently rigid that it limits dynamic lash to approximately 0.020-0.030".

5. The desmodromic valve system of claim 1, wherein said basket has a one-piece construction with solid side walls and open ends.

6. The desmodromic valve system of claim 1, wherein the internal profile of said basket is substantially the same around all of said cams.

7. The desmodromic valve system of claim 1, further comprising peripheral portions within said basket to resist flexing thereof.

8. The desmodromic valve system of claim 7, wherein said peripheral portions include a constant-radius disc disposed parallel to said side cams and substantially surrounded circumferentially by said basket.

9. The desmodromic valve system of claim 8, wherein said side cams each have a concavo-convex profile, wherein said basket has a central portion of substantially constant internal width between side walls thereof, and wherein a significant gap is present between each concavo-convex side cam and a given side wall when the concave part of said side cam is oriented toward the given side wall.

10. A desmodromic valve system for an internal combustion engine having a plurality of valves with valve stems operatively connected to a camshaft, said system comprising:

a semirigid basket disposed about said camshaft, said semirigid basket attached to a first valve stem and constrained to motion along the valve stem axis, said basket being flexible enough to elongate to contribute to the dynamic lash of the valve;

rotatable cam means mounted on said camshaft and disposed within said basket for coacting with said basket without substantially changing its shape to positively drive said valve stem in both directions along its axis and thereby provide reciprocating valve action with positive bidirectional drive.

11. The desmodromic valve system of claim 10, wherein said rotatable cam means includes first and second cams beside each other on said camshaft, said first cam aligned with the valve stem axis, said second cam parallel to said first cam and displaced from the valve stem axis.

12. The desmodromic valve system of claim 11, wherein said first and second cams are both disposed within said basket.

13. The desmodromic valve system of claim 12, further comprising a peripheral portion within said basket to resist flexing thereof.

14. The desmodromic valve system of claim 13, wherein said peripheral portion includes a constant-radius disc disposed parallel to said second cam and substantially surrounded circumferentially by said basket.

15. The desmodromic valve system of claim 14, wherein said second cam has a concavo-convex profile, wherein said basket has a central portion of substantially constant internal width between side walls thereof, and wherein a significant gap is present between said second cam and a given side wall when the concave part of said second cam is oriented toward the given side wall.

16. The desmodromic valve system of claim 12, wherein the internal profile of said basket is substantially the same around said first and second cams.

17. The desmodromic valve system of claim 11, wherein said first cam directly generates a downward force on the valve stem axis during a first part of a valve cycle, and said second cam generates an upward force on the valve stem axis during a second part of the valve cycle, the upward force applied to the upper portion of said basket so as to lift said basket and thereby lift said valve stem.

18. The desmodromic valve system of claim 17, further comprising a downwardly oriented cam follower in the upper portion of said basket above said second cam, said second cam acting on the upper portion of said basket through said cam follower.

19. The desmodromic valve system of claim 18, wherein the bottom portion of said basket has an integral retainer for securing it to said valve stem.

20. The desmodromic valve system of claim 11, wherein said first and second cams are configured such that the sum of their radii at any two diametrically opposed points on their respective cam surfaces is constant.

21. The desmodromic valve system of claim 10, wherein said basket is flexible enough to contribute materially to dynamic lash but sufficiently rigid that it experiences less than approximately 1% elongation in response to forces applied to it during a full valve cycle at camshaft speeds up to 5,000 RPM.

22. The desmodromic valve system of claim 21, wherein said basket is made of titanium and is sufficiently rigid that it limits dynamic lash to approximately 0.020-0.030".

23. The desmodromic valve system of claim 10, wherein said basket has a one-piece construction with solid side walls and open ends.

24. The desmodromic valve system of claim 10, wherein said rotatable cam means includes first, second and third cams beside each other on said camshaft, said first cam aligned with the valve stem axis and located between said second and third cams, which are equally displaced from the valve stem axis and from said first cam, all of said cams disposed within said basket.

25. A rockerless desmodromic valve system, comprising:

a first cam rotating on a camshaft and cyclically pushing a valve stem;

a second cam on the camshaft; and a band extending circumferentially around the second cam and engaging the valve stem, the second cam rotating within the band and causing it to reciprocate so as to cyclically lift the valve stem, said band configured to elongate axially as it lifts the valve stem, with a limit of approximately 1% elongation in response to the maximum force applied at camshaft speeds up to 5,000 RPM.

26. The desmodromic valve system of claim 25, wherein said first and second cams are beside each other on said camshaft, said first cam aligned with the valve stem axis, said second cam parallel to said first cam and displaced from the valve stem axis.

27. The desmodromic valve system of claim 26, wherein said first and second cams are both disposed within said band.

28. The desmodromic valve system of claim 26, wherein said first cam directly generates a downward force on the valve stem axis during a first part of a valve cycle, and said second cam generates an upward force on the valve stem axis during a second part of the valve cycle, the upward force applied to the upper portion said band so as to lift said band and thereby lift said valve stem.

29. The desmodromic valve system of claim 28, further comprising a downwardly oriented cam follower in the upper portion of said band above said second cam, said second cam acting on the upper portion of said band through said cam follower.

30. The desmodromic valve system of claim 29, wherein the bottom portion of said band has an integral retainer for securing it to said valve stem.

31. The desmodromic valve system of claim 26, wherein said first and second cams are configured such that the sum of their radii at diametrically opposed points on their respective cam surfaces is constant for the portion of said first cam including the outermost point on its cam lobe and a circumferential range on at least one side thereof of approximately 45° or more.

32. The desmodromic valve system of claim 25, wherein said band is sufficiently rigid that it limits dynamic lash to approximately 0.020-0.030".

33. The desmodromic valve system of claim 25, wherein said band has a one-piece construction with solid side walls and open ends.

34. The desmodromic valve system of claim 25, further comprising a third cam beside said first cam on said camshaft, said first cam aligned with the valve stem axis and located between said second and third cams, which are equally displaced from the valve stem axis and from said first cam, all of said cams disposed within said band.

35. The desmodromic valve system of claim 25, wherein said second cam has a concavo-convex profile, wherein said band has a central portion of substantially constant internal width between side walls thereof, and wherein a significant gap is present between said second cam and a given side wall when the concave part of said second cam is oriented toward the given side wall, further comprising a peripheral portion within said band to resist flexing thereof.

36. The desmodromic valve system of claim 35, wherein said peripheral portion includes a constant-radius disc disposed parallel to said second cam and substantially surrounded circumferentially by said band.

37. A desmodromic valve system for an internal combustion engine having a plurality of valves with valve stems operatively connected to a camshaft, said system comprising:

a semirigid band disposed about said camshaft, said semirigid band attached to a first valve stem and constrained to motion along the valve stem axis, said band configured to elongate axially in response to forces applied to it during a valve cycle, with a limit of approximately 1% elongation in response to the maximum force applied at camshaft speeds up to 5,000 RPM;

a plurality of cams mounted on said camshaft and disposed within said band for coacting with said band without substantially changing its shape to positively drive said valve stem in both directions along its axis and thereby provide reciprocating valve action with positive bidirectional drive.

38. The desmodromic valve system of claim 37, wherein said plurality of cams includes first and second cams beside each other on said camshaft, said first cam aligned with the valve stem axis, said second cam parallel to said first cam and displaced from the valve stem axis.

39. The desmodromic valve system of claim 38, wherein said first and second cams are both disposed within said band.

40. The desmodromic valve system of claim 38, wherein said first cam directly generates a downward force on the valve stem axis during a first part of a valve cycle, and said second cam generates an upward force on the valve stem axis during a second part of the valve cycle, the upward force applied to the upper portion said band so as to lift said band and thereby lift said valve stem.

41. The desmodromic valve system of claim 40, further comprising a downwardly oriented cam follower in the upper portion of said band above said second cam, said second cam acting on the upper portion of said band through said cam follower.

42. The desmodromic valve system of claim 41, wherein the bottom portion of said band has an integral retainer for securing it to said valve stem.

43. The desmodromic valve system of claim 38, wherein said first and second cams are configured such that the sum of their radii at any two diametrically opposed points on their respective cam surfaces is constant.

44. The desmodromic valve system of claim 37, wherein said band is sufficiently rigid that it limits dynamic lash to approximately 0.020-0.030".

45. The desmodromic valve system of claim 37, wherein said band has a one-piece construction with solid side walls and open ends.

46. The desmodromic valve system of claim 37, wherein said plurality of cams includes first, second and third cams beside each other on said camshaft, said first cam aligned with the valve stem axis and located between said second and third cams, which are equally displaced from the valve stem axis and from said first cam, all of said cams disposed within said band.

* * * * *